US005689221A

United States Patent [19]

Niiranen et al.

[11] Patent Number: 5,689,221

[45] Date of Patent: Nov. 18, 1997

[54] RADIO FREQUENCY FILTER COMPRISING HELIX RESONATORS

[75] Inventors: Erkki Niiranen, Saukonkuja; Jari Pelkonen, Tuomioja, both of Finland

[73] Assignee: LK Products Oy, Kempele, Finland

[21] Appl. No.: 539,820

[22] Filed: Oct. 6, 1995

[30] Foreign Application Priority Data

Oct. 7, 1994 [FI] Finland ..... 944701

[51] Int. Cl.[6] ..... H01P 1/20

[52] U.S. Cl. ..... 333/202; 333/219

[58] Field of Search ..... 333/202, 206, 333/207, 203–205, 219, 222

[56] References Cited

U.S. PATENT DOCUMENTS

| | | | |
|---|---|---|---|
| 3,621,484 | 11/1971 | Shult | 333/202 |
| 4,374,370 | 2/1983 | Poponski et al. | 333/202 |
| 4,740,765 | 4/1988 | Ishikawa et al. | 333/202 |
| 4,800,347 | 1/1989 | Yorita et al. | 333/202 |
| 4,816,788 | 3/1989 | Ishikawa et al. | 333/202 |
| 4,890,079 | 12/1989 | Sasaki | 333/202 |
| 4,977,383 | 12/1990 | Niiranen | 333/202 |
| 4,987,393 | 1/1991 | Yorita et al. | 333/202 |
| 5,047,739 | 9/1991 | Kvokkanen | 333/202 |
| 5,351,023 | 9/1994 | Niranen | 333/202 |
| 5,432,489 | 7/1995 | Yrjola | 333/202 |

FOREIGN PATENT DOCUMENTS

| | | | |
|---|---|---|---|
| 28 23 785 | 5/1978 | Germany | H01P 1/20 |
| WO82/03499 | 2/1982 | WIPO | H01P 1/20 |
| WO89/05046 | 10/1988 | WIPO | H01P 7/04 |

OTHER PUBLICATIONS

European Search Report –EP 95 30 7092 –IEEE Transactions on Parts, Materials & Packaging, vol. PMP–5, No. 3, Sep. 1969 –Field Analysis of Helical Resonators with Constant–Bandwidth Filter Application pp. 127–132 –Daniel J. Miley, Student Member, IEEE and James B. Beyer, Member IEEE.

*Primary Examiner*—Benny Lee
*Assistant Examiner*—Darius Gambino
*Attorney, Agent, or Firm*—Darby & Darby

[57] ABSTRACT

The invention relates to a radio frequency filter comprising at least two helix resonators (HX1–HX2) placed at a distance from each other, each of which is wound of a metal wire into a cylindrical coil. A conductor (MLIN2), preferably a microstrip line, runs between two neighboring resonators and is provided at a distance (d1, d2) from each of the resonator coils so that one part (3) of it is electromagnetically connected to one resonator (HX 1) and the other part (4) is electromagnetically connected to another resonator (HX2).

8 Claims, 9 Drawing Sheets

RADIO FREQUENCY FILTER COMPRISING HELIX RESONATORS

The invention relates to a radio frequency filter which comprises at least two helix resonators disposed at a distance from each other, each of which is formed by a metal wire wound into a cylindrical coil.

A filter comprising helix resonators is used widely in radio devices because of its good electrical properties and light structure. The resonator is a transmission line resonator and it is formed by a wire with a length of about a quarter of a wavelength wound into a cylindrical coil, which is placed in a grounded metal case. The characteristic impedance and accordingly the resonance frequency of the resonator are determined by physical dimensions of the cavity, by the ratio of the diameter of the helix coil to the inner dimension of the surrounding casing, and the distance between adjacent turns in the coil, i.e. the so called pitch, and the supporting structure possible used for supporting the coil. Therefore producing a resonator with exactly a desired resonance frequency requires an accurate and uniform structure.

A filter with desired properties can be built by cascading resonators and by arranging the coupling between them properly. When the filters get smaller especially in portable radio devices the accuracy requirements in production and assembly grow considerably, because even small variations in the dimensions of the cavity, the cylindrical coil and the supporting structure have great influence on the resonance frequency. When the filter is connected to an electrical circuit of a radio device its input and output ports must be matched with the circuit, i.e. the impedances from the ports to the filter must be the same as the impedances from the ports to the circuit to prevent reflections and transmission losses caused by sudden impedance changes. Also, the resonators of the filters must be matched with each other if the signal is brought to the filter by physical connection to its helix coil.

A suitable impedance level has to be found in the helix resonator, that is, a physical point of connection at which the impedance level of the resonator equals that of a device connected thereto or an adjacent resonator. The impedance level of the connection point is directly proportional to the electrical length between the point of connection and the short-circuited end of the resonator, whereby a lower or higher impedance level can be selected by moving the point of connection along the helix coil. This kind of matching is called tapping because the point of connection forms a tap point from the helix resonator. The tap connection point in the helix resonator can be determined by experimentation or by calculation using a calculated or measured characteristic impedance of the helix resonator, which is determined by the properties of the resonator. In many cases, the tap point in the helix resonator is made in its first turn.

Traditionally, tapping has been made by soldering one end of a discrete coil or conductor to the wire forming the helix resonator at the tap point. With decreasing filter sizes, the reproduction fidelity of such a tapping method has been found to be inadequate for series production. Inadequate accuracy in tapping results in a need for adjusting the tappings when tuning the filters, which increases tuning time and costs.

A better tapping method has been presented in the Finnish patent 80542. The principle is shown in FIG. 1. A helix resonator 106 has been placed around a projection 103 of finger-like insulating plate 101 so that the projection is positioned inside the resonator coil, and thus supporting the coil. The end portion of the first turn of the coil 106 close to the insulating plate 101 is bent to form a straight portion 102 which is positioned tightly against the surface of the insulating plate over its entire length. This straight portion is called the leg of the resonator. The end 107 of the straight portion 102 is connected to the casing 105 and is short-circuited through it. A micro-strip 108 is provided on the circuit board at the foot of the projection 103 and is connected to the rest of the resonator circuit or forms a part of a more extensive microstrip pattern provided on the insulating plate. The direction of the microstrip is the same as the axis of the coil. The tapping point is thus the place where the microstrip 108 crosses the straight portion 102 of the coil. The strip and the straight portion are soldered together at this point. The tapping point and thus the desired impedance level are determined by moving the place of the microstrip 108 sideways.

This method has the disadvantage of requiring several insulating plates which differ by the sideways position of the microstrip. This is a factor raising the expenses. Another disadvantage is that the tapping point cannot be fine tuned, because the leg must lie over the insulating plate. In practice, a leg lying over an insulating plate is not a very good solution, because a leg lying over an insulating plate with high losses increases the losses of the resonator.

A filter which has been tapped to a microstrip on the edge of a finger-like projection as described above is well known from prior art. This kind of filter is shown in FIGS. 2, 3 and 4, in which reference numbers the same as in FIG. 1 have been used when applicable. FIG. 2 shows a part of a filter, which is surrounded by a casing, with four discrete helix resonator circuits—the resonators 106 and 107 have been referred to separately—each of which is mounted around finger-like projections 103 of a printed board 101. This is called a comb structure. An electrical circuit formed by strip lines 108 and 108' runs at the bottom 101A of the insulating plate 101, to which circuit one or several resonators, like resonator 106, have been electrically connected by soldering at the tap point 121. Here the tap point is in the first turn of the coil but it can as well be placed higher. This possibility is shown in FIGS. 1–2 by resonator 107 in which the tap point 122 is in the second turn of the coil. In this case the microstrip protrudes little upwards on the finger-like projection and ends at the edge of it, whereto the turn of the resonator coil at that position is soldered. The tap point can thus be placed in any turn of the resonator coil and also several tap points can exist. The straight portion 102 of the resonator, unlike the leg in FIG. 1, is bent in parallel with the axis of the resonator and runs at a distance from the insulating plate and its other end is connected during the assembly phase to the bottom plate 31 of the casing, FIG. 3, and is grounded there through it if the plate is made of metal. The printed board of the radio device can also act as the bottom plate, at least one surface of which is coated with metal at the position of the filter, in which case the tip of the leg is connected to the metal coated surface.

FIG. 4 shows an assembled filter according to the state of the art in which the filter casing is cut open to show the resonator more clearly. This filter has walls between the resonator circuits, of which the walls 42 and 43 which are shown and which can have coupling holes (not shown in the figure) through which the circuit can be coupled electromagnetically to an adjacent circuit. The separating wall and the way the insulating plate, which supports the resonators is connected to the walls of the casing, are insignificant for the invention. The casing 41 is usually extruded aluminum and the bottom plate 44 can be a metal plate or a printed board with one metal coated surface. The tap points 21 and 22 of the helix resonators 6 and 7, which are shown, are marked with a black dot, and from this tap point the resonator is electrically connected to the microstrip circuit (not seen in Figure) provided on the bottom part 101A of the insulating plate and on the fingers 103. The tips 112 and 113 of the legs 102 and 102'are soldered to the bottom plate 44, if it or its coating is metal, or they are galvanically connected to the metal coating on the other side of the bottom plate, if the bottom plate is a printed board.

In radio frequency filters, which have at least two resonators, traditional fixed capacitors, which are suitable for relatively low frequency filters, can be used for providing the necessary coupling between the filter resonators. As the frequency increases the values of the coupling capacitors become so low that traditional capacitors cannot be used, but instead, for instance a board capacitance implemented on the printed board must be utilized, in which the necessary capacitance is formed by metal foil coupling electrodes on each side of the insulating material. In Helix filters described above and which have also been described e.g. in the U.S. Pat. Nos. 4,977,383 and 5,047,739 the couplings between the resonators are accomplished usually so that the separating metal wall has a hole of a certain size through which the resonators are coupled electromagnetically to each other. This has also been disclosed in the U.S. Pat. No. 5,157,363. When the hole is at the level of the open end of the resonators the coupling can be regarded mainly as capacitive and the holes can for simplicity be regarded as capacitors. The larger the hole of the separating wall is the higher is the capacitive coupling between the circuits. The amount of this coupling can be adjusted by altering the size of the hole in the separating metal wall. In this case, coupling holes of different sizes are often required in the same filter, whereby the tools required for making these holes together with the temporary tools required during the product development can raise the expenses considerably.

Changes of the mechanical position of the resonators in relation to the coupling hole alter the coupling between the circuits, which can be seen as deviations of the electrical properties of the filter. In addition, the inaccuracy in the production of the parts cause spreading in the couplings between the filter circuits.

FIG. 5 shows a circuit diagram of a typical band-pass filter consisting of two resonators, e.g. helix resonators. Usually the resonators are coupled so, that a coupling hole has been made in the separating metal wall between the resonators through which the resonance circuits are coupled. The capacitor C represents the capacitive coupling between the filter circuits. HX1 and HX2 represent transmission line resonators, preferably helix resonators and L1 and L2 represent coupling inductances by which resonators are coupled to the input and output ports, which usually have an impedance of 50 ohms. The length, the height in the cavity, the tap point etc. of the resonators must often be changed during the product development phase which means that the size of the coupling hole must be changed because of each change. This causes extra expenses to the product development and delays it.

The construction according to the invention can lessen or even completely remove the problems described above and considerable cost savings can be achieved. This is accomplished by a conductor between two neighboring helix resonators, which is coupled to both resonators electromagnetically. In this way the resonators are coupled with each other through this conductor. Preferably the conductor can be made to go inside both resonator coils near the edge of the coil so that the required electromagnetic coupling is achieved. In addition, the conductor is preferably a microstrip line, which has been arranged to run into both neighboring resonator coils on the insulating plate of a finger-like comb structured helix filter. Preferably the microstrip line is coupled to the resonator through a connection pad which is connected to the open end of the resonator coil or near to it, in which case the microstrip line is arranged near this pad so that it is mainly capacitively coupled to the pad.

By using the coupling arrangement according to the invention in helix resonators, especially during the development phase of the filters, making the required changes becomes easier and the development time of the product can be considerably reduced. Especially in very wide band filters e.g. in PCN filters, in which the width of the band is 75 MHz, the coupling between the circuits cannot even be accomplished properly with a traditional hole coupling.

For coupling the neighboring resonators to each other the arrangement according to the invention can be used alone and the filter can have a casing with no holes in the separating walls. Alternatively both the construction according to the invention and the coupling holes in the separating walls may be used for coupling between the resonators. When the coupling construction according to the invention is used, the hole in each separating wall of the casing of the helix filter can have the same size. In addition, the size of the connection hole can be selected so that the coupling is preferably mainly done through the hole and the remaining part of it is done by using the arrangement according to the invention in which a conductor, preferably a microstrip line, arranged near the resonator coil is used to make the required additional electromagnetic (capacitive) coupling. When the hole and conductor connection are used together the hole can have a standardized size and it is still possible to produce different kind of filters, e.g. such, which differ from each other by bandwidth and frequency, by only changing the properties of the connection conductor according to the requirements. In this case only one tool instead of several ones is required for making the holes in the manufacturing of the filter. Different versions of filters are made easier and more quickly because only manufacturing a new conductor, e.g. a strip line on a printed board, is required for making changes in coupling, whereby also the development time of the product can be reduced considerably.

The invention is characterized in that it comprises a conductor provided between two neighboring resonators, which is disposed at a distance from both resonators so that one part of the conductor is electromagnetically coupled to one resonator and another part of the conductor is electromagnetically coupled to the other resonator.

The invention is described more thoroughly with the adjoining figures, in which.

Figure 1:
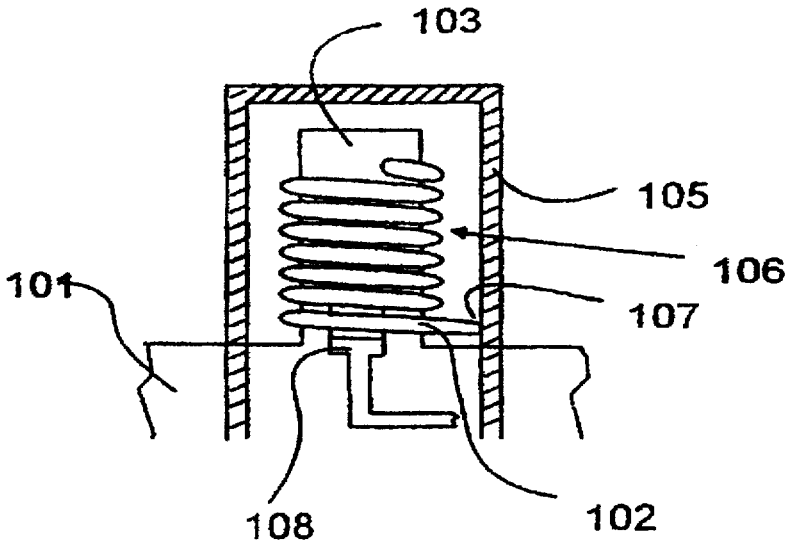
FIG. 1 (PRIOR ART)
FIG. 1 shows a prior known tapping of the resonator.
Figure 2:
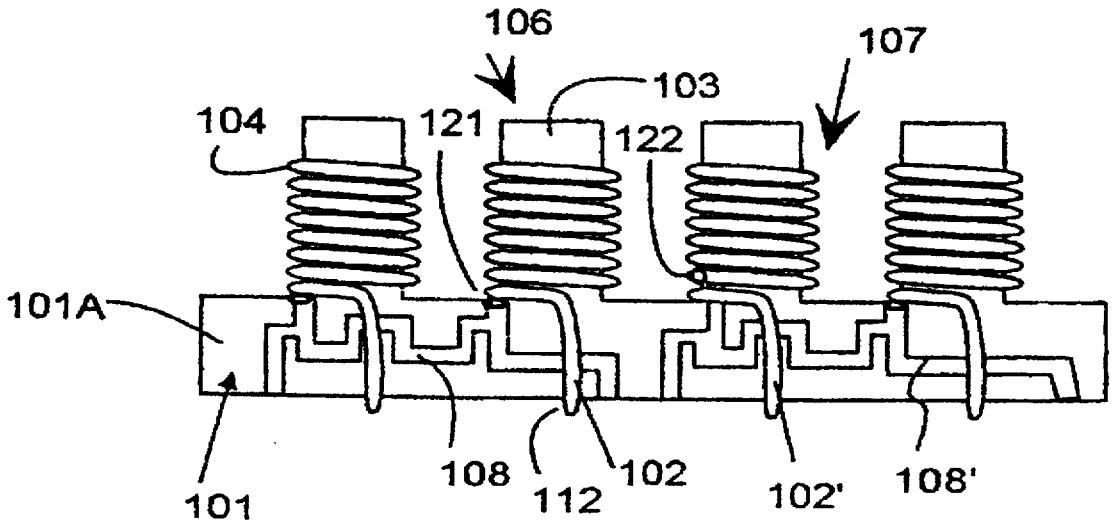
FIG. 2 (PRIOR ART)
FIG. 2 shows the resonators of a prior known four circuit filter.
Figure 3:
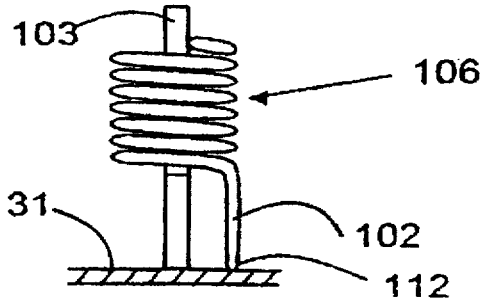
FIG. 3 (PRIOR ART)
FIG. 3 is a side view of one of the resonators in FIG. 2.
Figure 4:
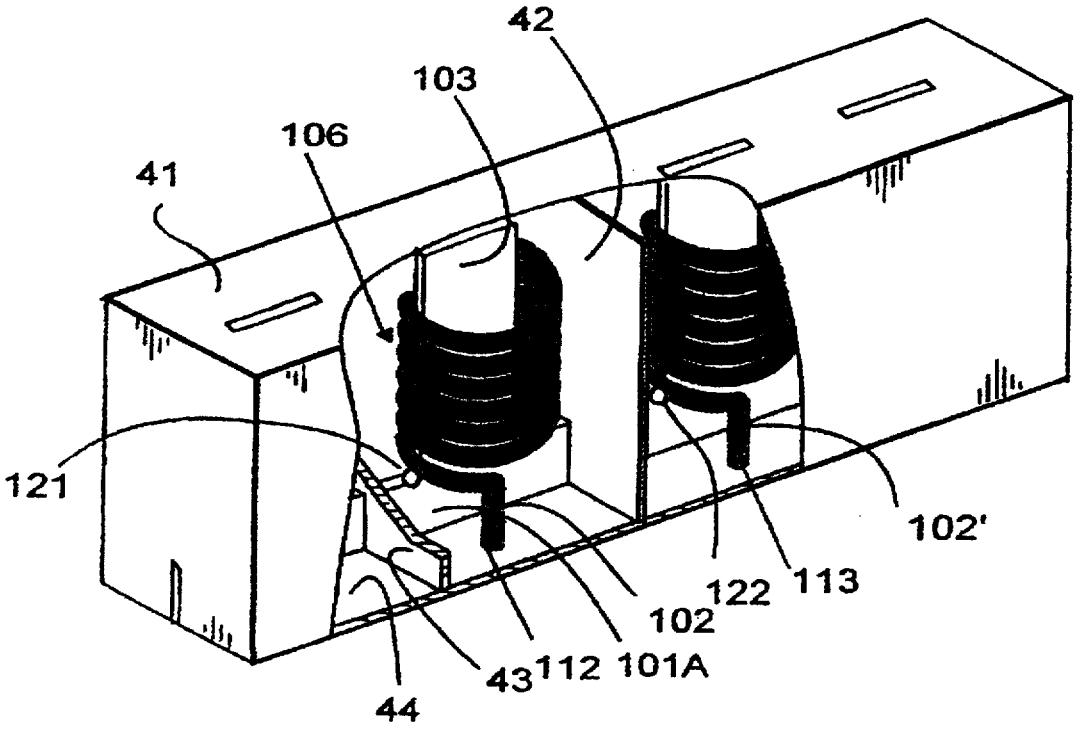
FIG. 4 (PRIOR ART)
FIG. 4 shows a prior known filter partially opened.
Figure 5:
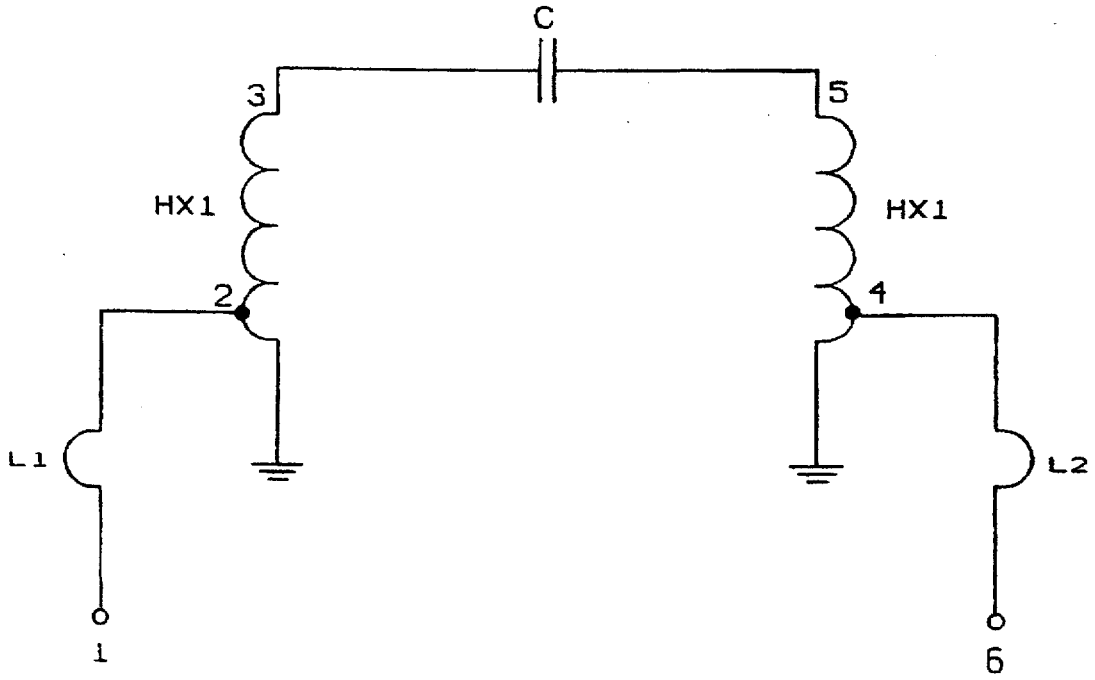
FIG. 5 (PRIOR ART)
Figure 7:
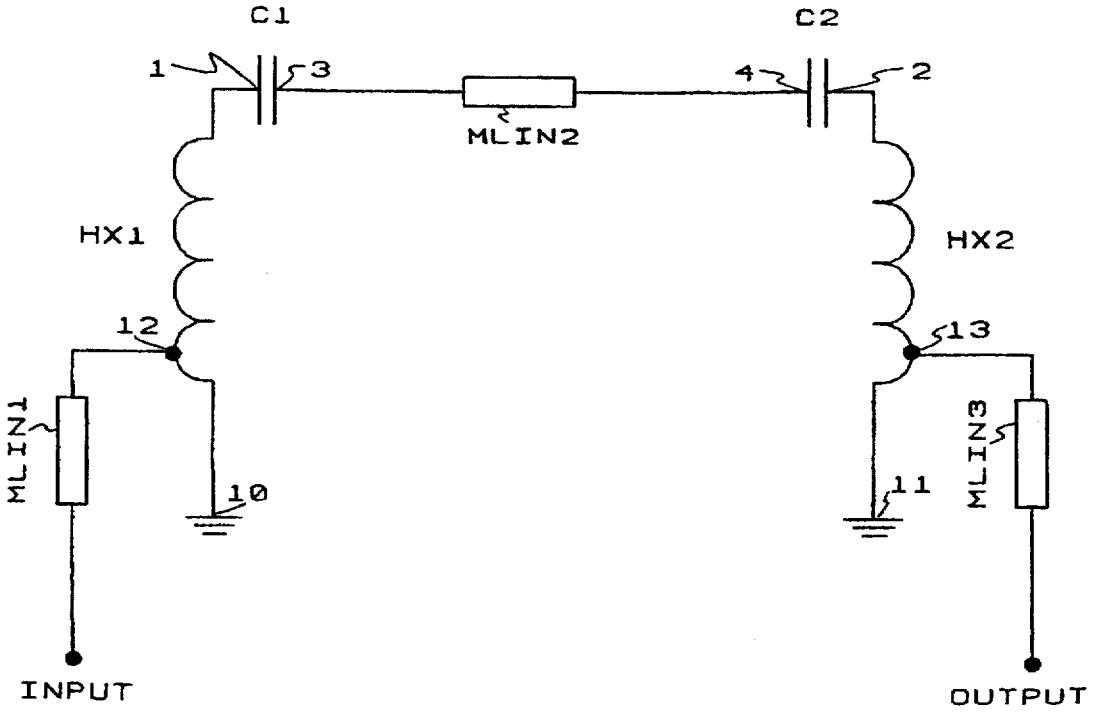
Figure 6A:
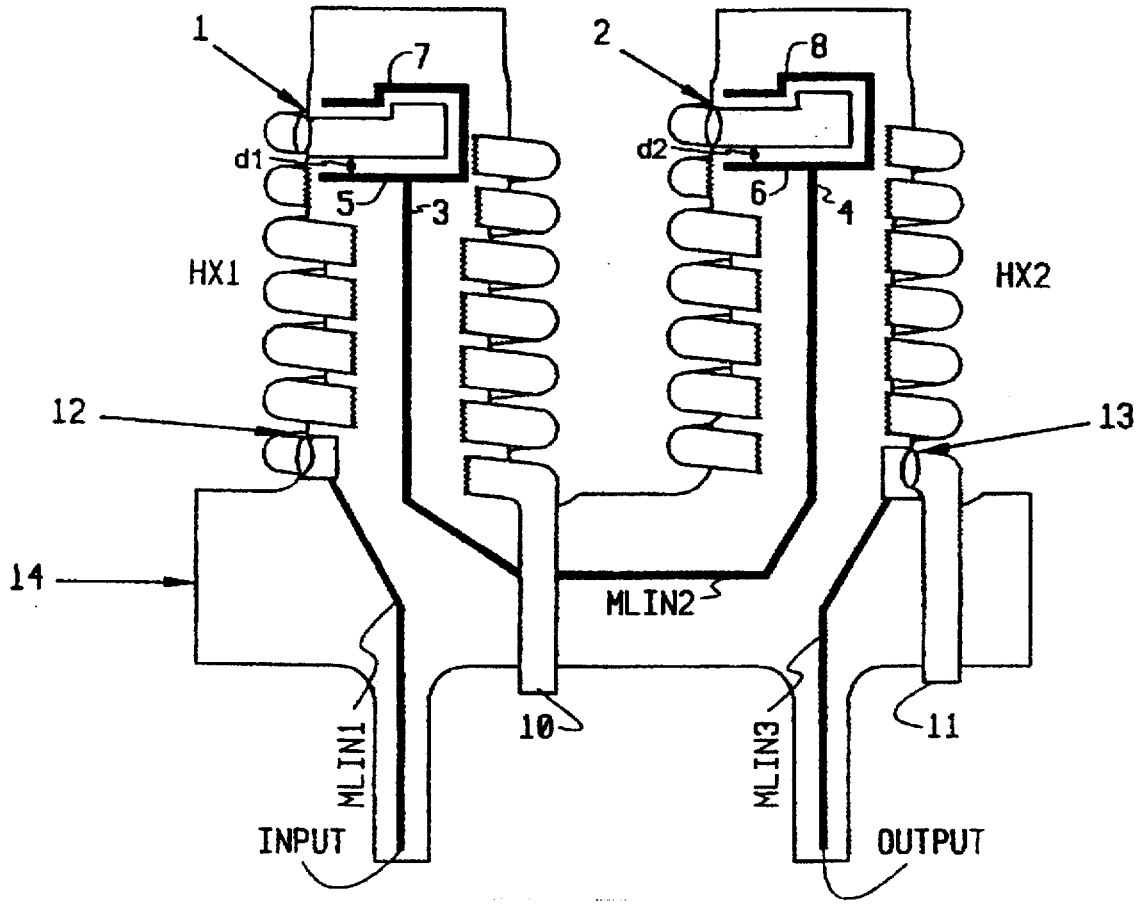
Figure 6B:
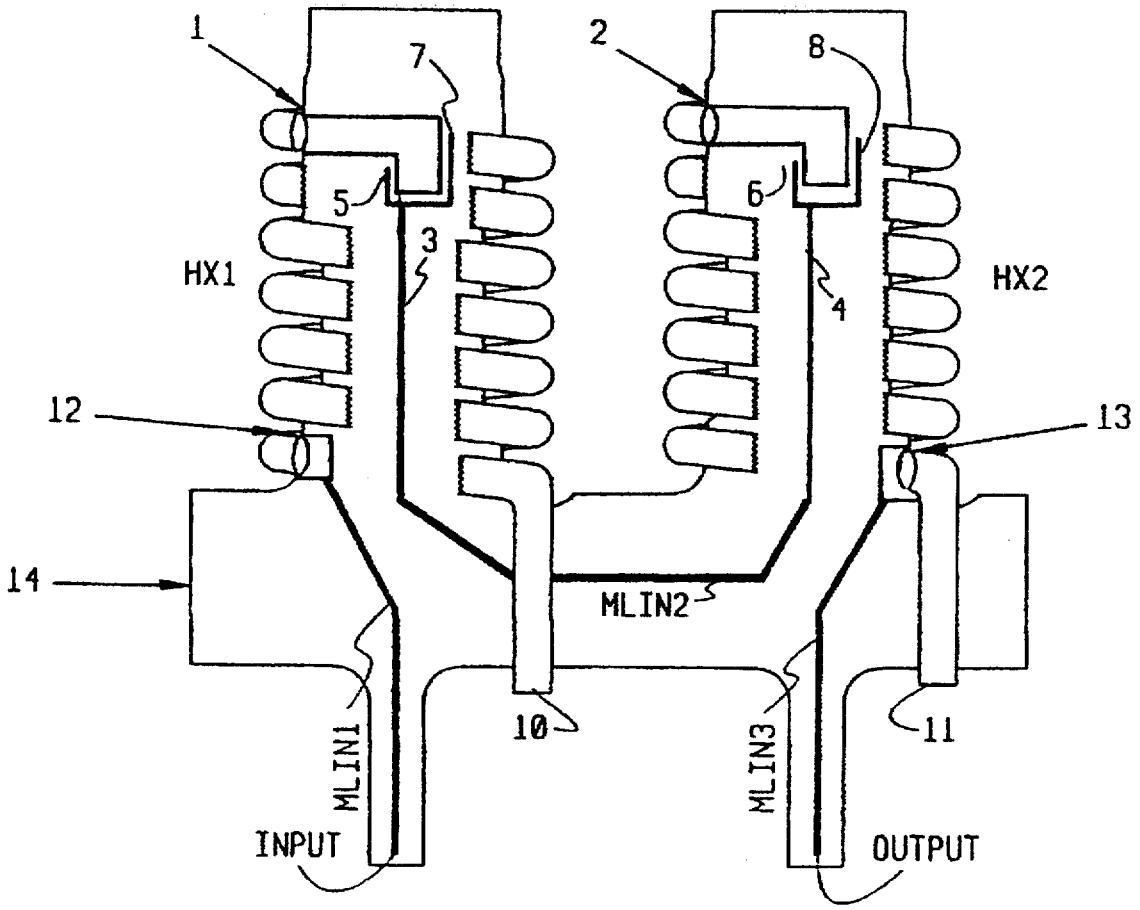
Figure 6C:
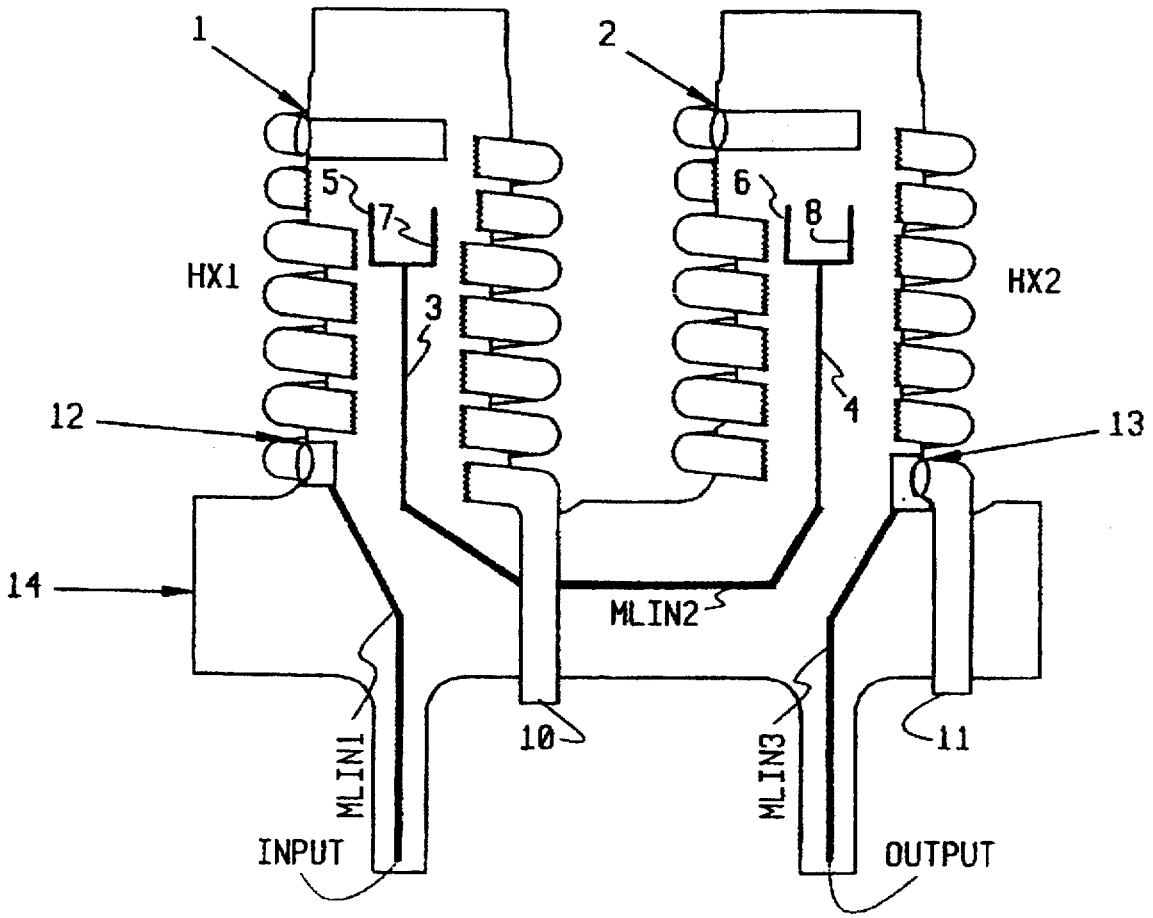

FIG. 5 shows the circuit diagram of a known band-pass filter comprising two resonators, FIG. 6A shows a filter construction according to the invention for coupling two helix resonators to each other, FIG. 6B shows a filter construction according to the invention for coupling two helix resonators to each other, FIG. 6*c* shows a filter construction according to the invention for coupling two helix resonators to each other, FIG. 7 shows the circuit diagram of the construction in FIG. 6.

Figure 8A:
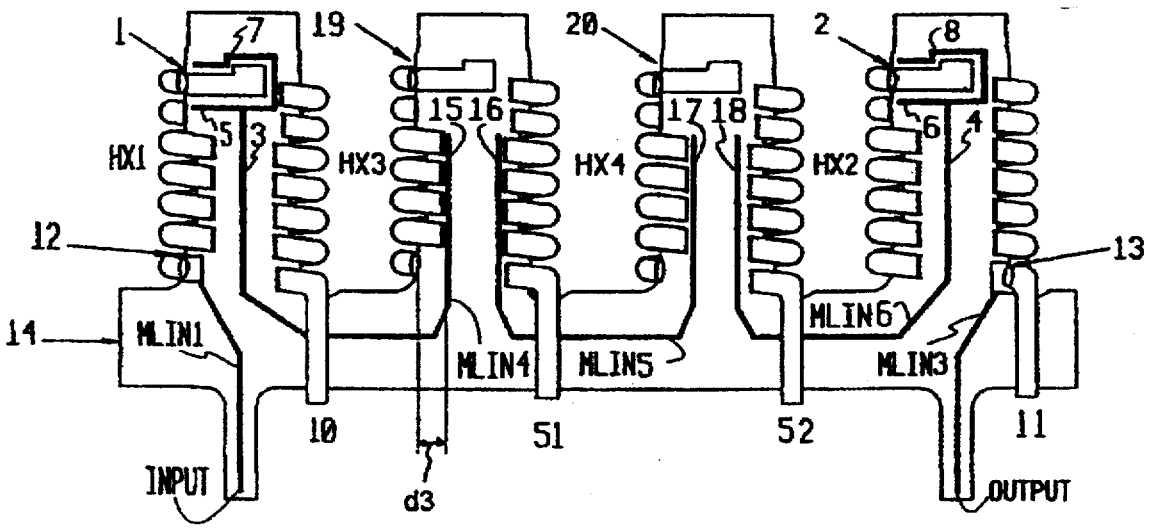
Figure 8B:
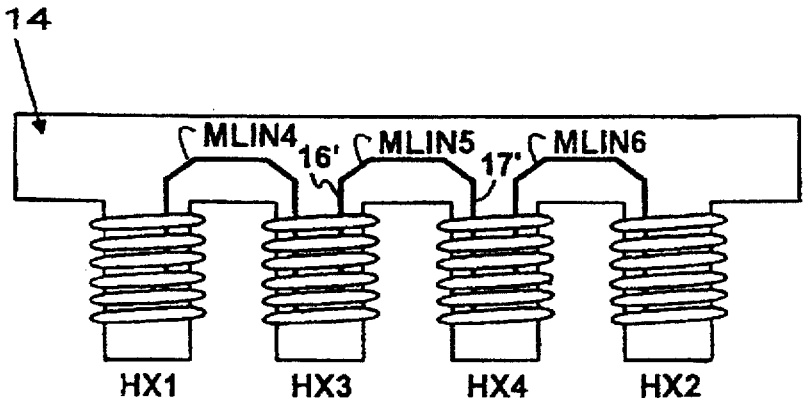
Figure 9:
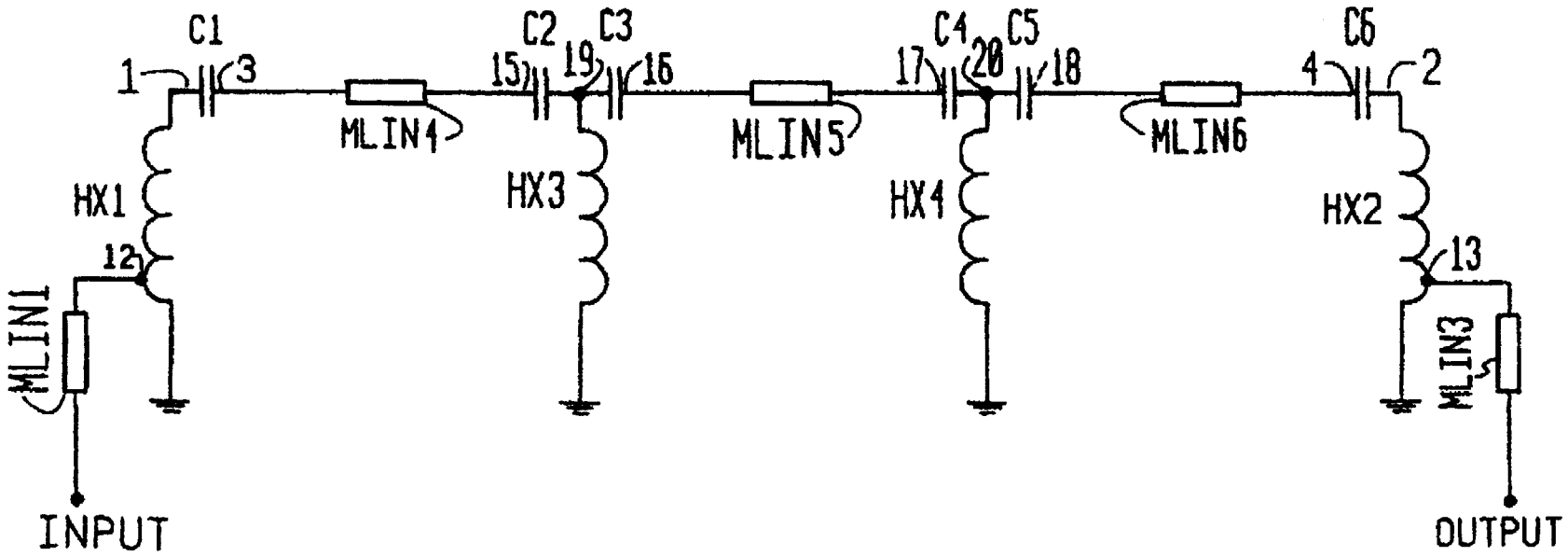
Figure 10A:
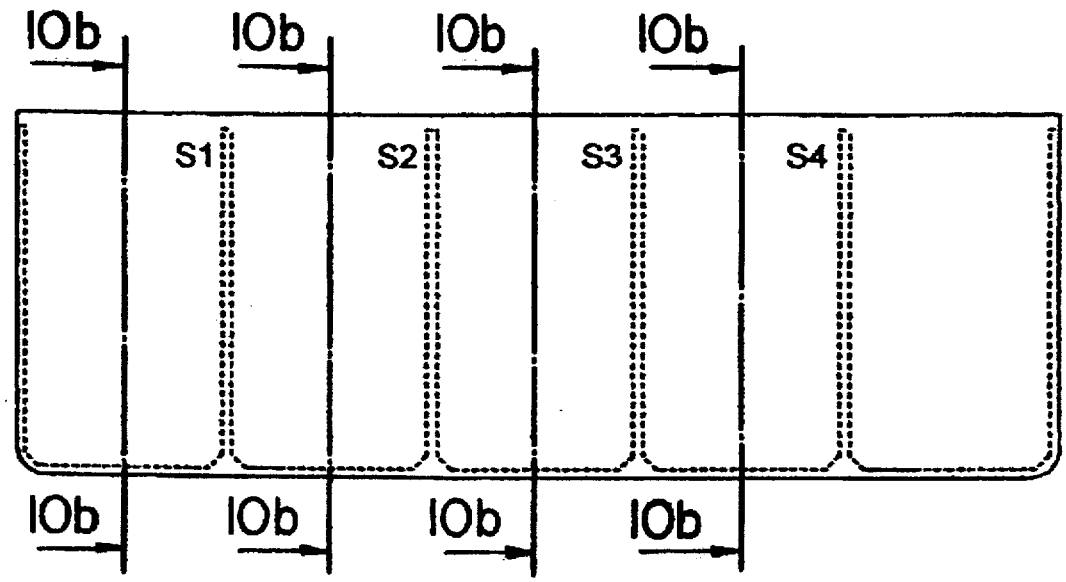
Figure 10B:
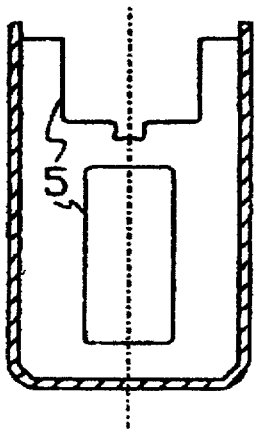

FIG. 8A shows another filter construction according to the invention,

FIG. 8B shows a construction according to one embodiment seen from the opposite side than in FIG. 8*a*, FIG. 9 shows the circuit diagram of the construction in FIG. 8, FIG. 10A shows a cross-sectional front view of the casing of a filter comprising helix resonators, and FIG. 10B shows a sectional side view of FIG. 10A at each of lines 10b.

A description of FIGS. 1–5 was given earlier in connection with the description of the state of the art.

A resonator structure according to the invention is shown in FIG. 6, which shows a filter made of two helix resonators HX1, HX2. The helix resonators are made of a metal wire wound into a cylindrical coil and encircle a projection of an insulating plate, although the turns are shown cut so that the structure according to invention is exposed more clearly. The helix resonators HX1 and HX2 are connected from their open ends to the connection points or connection pads 1, 2 on the printed board 14 and from their tap points to the tapping pads 12 and 13. On the surface of the printed board a connection strip MLIN2 is provided near the connection pads between each resonator HX1, HX2 so that a part 3, 4 of the connection strip MLIN2 runs inside each resonator. The parts 3, 4 of the connection strip branch further into two parts 5,6 and 7,8 around the connection pads, whereby the branches of the strip form a capacitive coupling between the the connection pads 1, 2 and the connection strip MLIN2. The parts 3 and 4 of the connection strip MLIN2 could as well run near the connection pads and be coupled to them electromagnetically without branching. The connection conductor (the connection strip) according to the invention is not restricted to the form and size shown here. The connection strips can also be branched in the manner illustrated in FIG. 6B. In FIG. 6C the coupling to the resonator can be done by an electromagnetic field and the connection strip MLIN2 is not required to run in close vicinity to the connection pad 1.

Near the open end (top) of the resonator the coupling between connection strip and the resonator is mainly capacitive, but also inductive coupling can exist. Part of the electromagnetic coupling is produced by the coupling between the helix resonators HX1, HX2 and the parts 3, 4 of the connection strip, although coupling to the connection pads 1,2 is more effective in the form shown in FIG. 6. There is a powerful electric field inside the helix resonators HX1, HX2 and especially near the open end (in Figure, the top) of the resonator the electric field is very powerful so that a sufficient connection to the resonator is possible through a strip line running inside the helix resonator. The strength of the capacitive coupling is influenced by the closeness of the connection pads 1 and 2 to the branches 3, 5, 7 and 4, 6, 8 of the connection strip, by the distance d1, d2 between the microstrip line and the turns of the coil of the helix resonator HX1, HX2 or by the properties of the connection strip MLIN2, the form of the strip, its width and closeness to the turns of the helix resonator.

If it is desired to reduce the coupling between resonators, the length of the branches 5 and 6 and/or 7 and 8 can most preferably be shortened or completely removed. In the latter case, by adjusting the length of the microstrip line MLIN2 the strength of the capacitive coupling can be influenced most easily. The shorter the part of the MLIN2, which runs inside the helix resonator the weaker capacitive coupling is produced and vice versa. The high-frequency signal to be coupled is brought to the filter with the strip line MLIN1, which is provided between the INPUT port of the filter and the connection point 12 of the first helix resonator HX1 and respectively at the output of the filter the strip line MLIN3 is provided between (the connection point 13 of) the last resonator HX2 and the OUTPUT port of the filter. These strip lines MLIN1, MLIN3 function as transmission lines/inductances.

FIG. 7 shows a circuit diagram of the structure according to FIG. 6. The capacitors C1 and C2 are formed in the manner described above between the connection point 1 and the part 3, 5, 7 of the connection strip and respectively between the part 4 (6, 8) and the connection point 2. Reference numbers 10 and 11 indicate the legs of the resonators HX1, HX2 in FIG. 6, which are connected to the casing of the filter, for which reason they are illustrated as groundings in FIG. 7. FIG. 6 shows one embodiment of the invention and in other solutions according to the invention the microstrip lines described above can have different properties with regard to form, width and length of the strip. In some filters the couplings desired between the resonators are so small that even a short connecting microstrip line inside a helix resonator or near it is enough to produce the capacitive coupling required. This is illustrated by an example in FIG. 8A, in which the parts 16, 17 of the connection strip MLIN5 and the parts 15 and 18 of the connection strips MLIN4 and MLIN6 end before the top of the helix resonators HX3, HX4.

FIG. 8A illustrates a band-pass filter comprising four resonators. The helix resonators are designated by references HX1–HX4, the connection strips according to the invention are designated by references MLIN4-MLIN6, the INPUT and OUTPUT connection strips are designated by references MLIN1 and MLIN3. The helix resonators are formed of metal wires wound into a cylindrical coil, i.e. encircle a projection of the insulating plate, even if the turns of the coils of the helix resonators are shown cut to expose the structure better. The circuit diagram of the filter illustrated in FIG. 8A is shown in FIG. 9, in which the capacitors C1 and C6 are coupling capacitors of the kind shown in FIG. 6. The capacitive connection to the resonators HX3, HX4 in the middle, between the end resonators HX1, HX2, is also accomplished using strip lines, but these are not connected to the connection pads but directly to the resonator coil. The capacitance C2 is formed by the capacitive connection between (the branch 15 of) the strip line MLIN4 and the resonator HX3. The capacitance C3 again is formed by the capacitive connection between (the branch 16 of) the strip line MLIN5 and resonator HX3. Correspondingly the capacitance C4 is formed by the capacitive connection between (the branch 17 of) the strip line MLIN5 and the resonator HX4 and correspondingly the capacitance C5 is formed by the capacitive connection between (the branch 18 of) the strip line MLIN6 and the resonator HX4. The strip lines, which run near the resonators, in this case inside the resonator coils, form the coupling capacitances C2, C3, C4, C5 when the strip lines are coupled to the resonators. As well these strip lines could run outside the resonators, however, in the vicinity of the resonators. If the capacitive coupling between the resonators HX3 and HX4 is required to be reduced, the strip lines MLIN4 and/or MLIN5 can be shortened. The width of the strip line can be made narrower or the strip line can be moved sideways to adjust the distance d3 of the strip line from the resonator.

The coupling between resonators can also be arranged so that microstrip lines run on the opposite side to connection pads 1, 2, 19 and 20 on the printed board 14. In this case, the additional connections required, e.g. for producing the zero points required for the response, can be made on the spare space of the other side. The connection strips MLIN4, MLIN5, MLIN6 can be laid on the opposite side to the other coupling strips. This is shown in FIG. 8B. In this case, connection strips MLIN4, MLIN5, MLIN6 do not run on the front side of the insulating plate.

In one embodiment according to the invention this problem is lessened essentially. In this embodiment both the hole connection described earlier and the strip connection also described earlier are used. In FIGS. 10A and 10B which show a casing of a band-pass filter, the separating metal walls S1, S2, S3, S4 of the casing have all preferably same sized connection holes 5 through which an electromagnetical coupling is achieved between the resonators, which is mainly a capacitive coupling. The size of the coupling hole is either selected to preferably produce the main part of the coupling and the rest of the coupling is produced by the coupling arrangement according to the invention, in which with a conductor, preferably a microstrip line provided near the resonator coil the additional capacitive coupling required is accomplished. By using hole and conductor (mictrostrip line) couplings together, different filters with only one standard connection hole can be produced, e.g. such filters, which differ from each other by the bandwidth or frequency, can be produced only by changing the properties of the connection conductor (microstrip line) according to the invention to respond each situation. Only one tool is required for manufacturing the filter for forming the connection holes instead of several tools required earlier. Filter versions with different properties are produced more easily and faster because the coupling can be changed by making only a new strip line pattern on a printed board, whereby also the development of the product is faster.

We claim:

1. A radio frequency filter comprising at least two discrete helix resonators placed at a distance from each other, each of which is wound of metal wire into a cylindrical coil, the radio frequency filter comprising:

at least one microstrip line conductor having first and second ends, the at least one microstrip line extending between the at least two resonators whereby the first end extends within an inner portion of one of the resonators and the second end extends within an inner portion of another one of the resonators such that the first end of the microstrip line conductor is connected electromagnetically to one resonator and the second end of the microstrip line conductor is connected electromagnetically to the other resonator.

2. A radio frequency filter according to claim 1, wherein at least a portion of the microstrip line conductor is disposed external of the coils of the at least two discrete helix resonators.

3. A radio frequency filter according to claim 1, further comprising an insulating plate having at least two projections for supporting each cylindrical coil of each resonator whereby each cylindrical coil is respectively wound around a respective projection and the at least one microstrip line conductor is disposed on the surface of the insulating plate, the insulating plate further includes an electric circuit formed of at least two other microstrip lines for connecting to the resonators.

4. A radio frequency filter according to claim 3, further comprising a connection pad provided on each of the projections of the insulating plate whereby each connection pad is in contact with an open end of a said coil and each of the first and second ends of the at least one microstrip line conductor is electromagnetically coupled to a said respective coil through one of the connection pads.

5. A radio frequency filter according to one of the previous claims, wherein the at least one microstrip line conductor is capacitively coupled to the at least two discrete helix resonators.

6. A radio frequency filter according to claim 4, further comprising at least two other discrete helix resonators and at least one microstrip line provided on both sides of the insulating plate.

7. A radio frequency filter according to claim 4 or 6, wherein each said connection pad in contact with each said resonator coil is on a first side of the insulating plate (14) and on the opposing second side of the insulating plate is at least one of the microstrip line conductors connecting adjacent resonators 8. A radio frequency filter according to claim 1, further comprising a metal casing in which the helix resonators are separated from each other by a separating metal wall, which has a hole through which adjacent resonators are connected electromagnetically to each other.

* * * * *